United States Patent [19]

Waid et al.

[11] 4,256,517

[45] Mar. 17, 1981

[54] WELDED ALLOY CASING

[75] Inventors: George M. Waid, Burton; Anthony T. Davenport, Shaker Heights, both of Ohio

[73] Assignee: Republic Steel Corporation, Cleveland, Ohio

[21] Appl. No.: 72,172

[22] Filed: Sep. 4, 1979

Related U.S. Application Data

[63] Continuation-in-part of Ser. No. 868,261, Jan. 9, 1978, Pat. No. 4,189,333.

[51] Int. Cl.[3] ..... C22C 38/06

[52] U.S. Cl. ..... 148/36; 75/126 B; 138/177; 148/12 F

[58] Field of Search ..... 148/36, 12 F; 75/126 B; 138/171, 177

[56] References Cited

U.S. PATENT DOCUMENTS

| | | | |
|---|---|---|---|
| 2,218,888 | 10/1940 | Marchetti | 75/126 |
| 2,395,688 | 2/1946 | Selmi et al. | 75/126 |
| 2,416,649 | 2/1947 | Selmi et al. | 148/31 |
| 2,572,191 | 10/1951 | Payson | 75/126 |
| 2,858,206 | 10/1958 | Boyce et al. | 75/126 |
| 3,155,500 | 11/1964 | Anthony et al. | 75/126 |
| 3,271,138 | 9/1966 | Ohtake et al. | 75/125 |
| 3,288,600 | 11/1966 | Johnson, Jr. et al. | 75/126 |
| 3,348,981 | 10/1967 | Goda et al. | 148/36 |
| 3,403,060 | 9/1968 | Ito et al. | 148/36 |
| 3,404,249 | 10/1968 | Dorschu | 219/74 |
| 3,431,101 | 3/1969 | Kunitake et al. | 75/124 |
| 3,463,677 | 8/1969 | Nakamura et al. | 148/36 |
| 3,528,088 | 9/1970 | Seghezzi et al. | 148/143 |
| 3,726,724 | 4/1973 | Davies | 148/36 |
| 3,847,678 | 11/1974 | Furr | 148/2 |
| 4,025,368 | 5/1977 | Sanbongi et al. | 148/36 |
| 4,060,431 | 11/1977 | Brandis et al. | 148/36 |

*Primary Examiner*—L. Dewayne Rutledge
*Assistant Examiner*—Upendra Roy
*Attorney, Agent, or Firm*—Watts, Hoffmann, Fisher & Heinke Co.

[57] ABSTRACT

A welded tubular steel product having a high ultimate tensile strength of at least 95 ksi and a relatively low yield strength in a range of from 55 to 80 ksi is made by alloying a plain carbon-manganese steel solely with chromium.

2 Claims, 6 Drawing Figures

CHROMIUM STEEL, AS WELDED PIPE, 0.480 INCH WALL THICKNESS

VANADIUM STEEL, AS WELDED PIPE, 0.380-INCH WALL THICKNESS

VANADIUM STEEL, AS WELDED PIPE, 0.480-INCH WALL THICKNESS

CHROMIUM STEEL, AS WELDED PIPE, 0.380-INCH WALL THICKNESS

CHROMIUM STEEL, AS WELDED PIPE, 0.480 INCH WALL THICKNESS

WELDED ALLOY CASING

CROSS-REFERENCE TO RELATED APPLICATION

This application is a continuation-in-part of application Ser. No. 868,261, entitled "Welded Alloy Casing" filed Jan. 9, 1978 and now U.S. Pat. No. 4,189,333.

BACKGROUND OF THE INVENTION

The present invention relates generally to welded tubular steel products, and more specifically to the production of electrical resistance welded alloy casing characterized by a high ultimate tensile strength and a relatively low yield strength comparable to that of plain carbon-manganese steels currently used.

A typical carbon-manganese steel consists essentially of about 0.33% carbon, 1.32% manganese, 0.30% silicon and the balance iron. These conventionally used steels require high normalizing temperatures of from 1700° to 1750° F. in order to approach minimum tensile strength requirements of about 95 ksi. Even when normalized at high temperatures, it has been difficult consistently to meet minimum tensile strength requirements in casing having wall thicknesses of about ⅜ inch and greater.

Attempts have been made to improve the tensile strength of carbon-manganese steels by alloying them with a number of elements such as molybdenum, vanadium, chromium, nickel, columbium, titanium and zirconium in varying amounts. In many instances, the higher tensile strengths of the alloyed steels were accompanied by increased yield strengths and inferior welding properties. It has also been found that the desired minimum strength requirement of 95 ksi could not be consistently attained in some of the alloyed steels when normalized at temperatures below about 1700° F., this being particularly true in casing having wall thicknesses of about ⅜ inch or greater.

SUMMARY OF THE INVENTION

A purpose of the present invention is to provide a new alloy steel having a relatively low yield strength compared to its ultimate tensile strength, whereby the steel is suitable for making high strength, electrical resistance welded tubular products. A more specific purpose of the invention is to provide a welded alloy steel casing having an ultimate tensile strength in excess of 95 ksi and a relatively low yield strength in a range of from about 55 to 80 ksi.

It has been found that the tensile strength of plain carbon-manganese casing steel can be increased to a level in excess of 95 ksi without appreciably increasing the yield strength by alloying the steel solely with chromium in an amount of from about 0.20 to 1.00%. The yield strength to ultimate tensile strength ratio of the new steel is lower than that of the conventional plain carbon-manganese steels, this being especially true in the case of wall sections having a thickness of ⅜ inch or greater. As distinguished from previously proposed alloy casing steels, the new steel of the invention can be normalized at temperatures below 1700° F., e.g., about 1450° F., to obtain consistently with tensile strengths.

The invention provides a new, normalized, welded tubular product formed of a steel consisting essentially of the following elements in amounts by weight based on the total weight of the steel: from 0.20 to 0.40% carbon, from 1.00 to 1.75% manganese, from 0.15 to 0.50% silicon, from 0.20 to 1.00% chromium, from 0.01 to 0.05% aluminum, and the balance iron except for normal residual constituents resulting from ordinary steel making practices. The new steel is further characterized by a high tensile strength of at least 95 ksi and a relatively low yield strength in a range of from about 55 to 80 ksi.

In a specific embodiment of the invention, the new welded tubular steel casing consists essentially of from 0.25 to 0.30% carbon, from 1.25 to 1.50% manganese, from 0.20 to 0.35% silicon, from 0.40 to 0.60% chromium, from 0.01 to 0.05% aluminum and the balance iron except for the normal residual constituents.

The carbon content required in the casing steel of this invention to achieve the desired minimum tensile strength of 95 ksi will vary depending upon the wall thickness, this being particularly true in casing having wall thicknesses up to about ½ inch. In general, the required carbon content is less in thin wall casing than in heavier sections exceeding ½ inch. The preferred carbon range is from about 0.28 to 0.40% for casing having a wall thickness of ⅜ inch or more.

Other features and a fuller understanding of the invention will be had from the accompanying drawings and the following detailed description.

DESCRIPTION OF PREFERRED EMBODIMENTS

Figure 1:
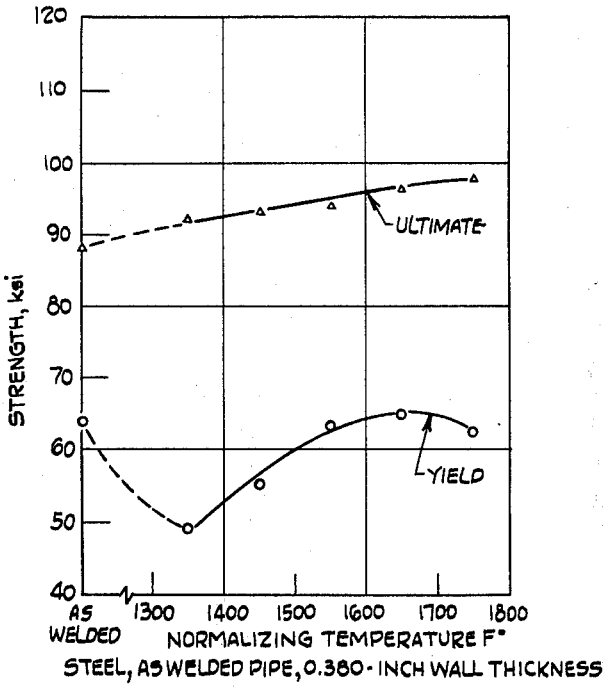
FIGS. 1 and 2 are graphs showing the yield and ultimate tensile strengths of a conventional carbon-manganese steel casing of two different wall sections normalized at varying temperatures.
Figure 2:
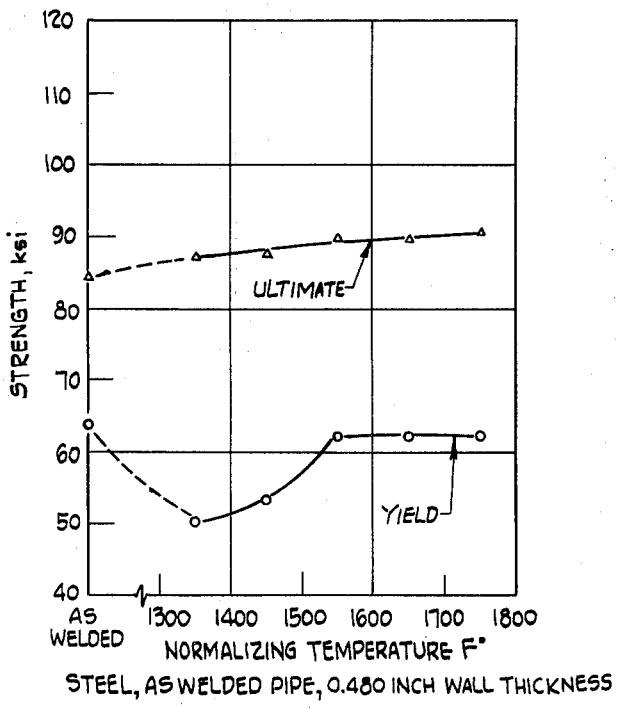

Investigations were conducted on three heats of steel to evaluate the effects of alloying elements and normalizing temperatures in meeting the high strength requirements of as-welded casing, i.e., an ultimate tensile strength of at least 95 ksi and a yield strength in a range of from about 55 to 80 ksi. One heat was a carbon-manganese steel of a type conventionally used in making electrical resistance welded casing, the second was a vanadium-containing steel, and the third was a chromium-containing steel according to the present invention.

As hereinafter described in greater detail, it was necessary to normalize the carbon manganese steel casing at a temperature above 1550° F. in order to meet the minimum tensile strength requirement in a 0.380 inch wall section. The minimum ultimate tensile strength requirements could not be achieved in heavier sections of 0.480 inches or greater even when normalized at temperatures of 1750° F.

The vanadium-containing steel was found to have little or no advantages over the carbon-manganese steel. It was necessary to heat treat the steel to temperatures above 1550° F. in order to meet the minimum strength requirements.

The chromium alloyed steel in the as-welded pipe condition exceeded all of the minimum strength requirments even in the thicker wall sections. At the same time, the yield strength was maintained in the desired range of from 55 to 80 ksi. and at a level below the yield strength of the vanadium alloyed steel casing. The resulting product was characterized by a yield to ultimate tensile strength ratio less than that of the plain carbon-manganese steel. The improved mechanical properties were obtained in all wall sections at a relatively low normalizing temperature of about 1450° F.

The chemical compositions of casing made from three heats of steel which were the subject of the investigation are set forth in Table I. The test results indicating the effects of normalizing temperature on mechanical properties of casing processed in walls sections of 0.380 and 0.480 inches are presented Tables II through VII and shown graphically in FIGS. 1 through 6.

TABLE I

CHEMICAL COMPOSITIONS OF CASING MATERIALS

| Heat | Type | C | Mn | Si | P | S | Al | Cu | Ni | Cr | V |
|---|---|---|---|---|---|---|---|---|---|---|---|
| 4497226 | C-Mn | 0.33 | 1.32 | 0.30 | 0.015 | 0.024 | 0.021 | 0.02 | 0.02 | 0.03 | 0.01 |
| 4423718 | Vanadium | 0.33 | 1.33 | 0.26 | 0.010 | 0.026 | <0.01 | 0.02 | 0.02 | 0.02 | 0.084 |
| 4423927 | Chromium | 0.28 | 1.43 | 0.32 | 0.010 | 0.018 | 0.019 | 0.03 | 0.03 | 0.51 | 0.01 |

TABLE II

MECHANICAL PROPERTIES OF WELDED AND NORMALIZED C—Mn STEEL (HEAT 4497226, 0.380-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| S3-380-11 | 64.5 | 88.2 | | 25.0 | As-Welded |
| S3-380-12 | 63.8 | 88.2 | | 25.0 | As-Welded |
| Average | 64.2 | 88.2 | .728 | 25.0 | |
| S3-380-1 | 47.9 | 91.3 | | 29.5 | Normalized 1350 F for 30 Min., A.C. |
| S3-380-2 | 49.6 | 92.2 | | 28.0 | Normalized 1350 F for 30 Min., A.C. |
| Average | 48.8 | 91.8 | .532 | 28.8 | |
| S3-380-3 | 55.3 | 93.3 | | 29.5 | Normalized 1450 F for 30 Min., A.C. |
| S3-380-4 | 55.3 | 92.4 | | 29.5 | Normalized 1450 F for 30 Min., A.C. |
| Average | 55.3 | 92.9 | .595 | 29.5 | |
| S3-380-5 | 61.6 | 94.5 | | 29.0 | Normalized 1550 F for 30 Min., A.C. |
| S3-380-6 | 64.9 | 96.0 | | 29.0 | Normalized 1550 F for 30 Min., A.C. |
| Average | 63.3 | 95.3 | .664 | 29.0 | |
| S3-380-7 | 64.8 | 96.0 | | 30.0 | Normalized 1650 F for 30 Min., A.C. |
| S3-380-8 | 64.9 | 96.5 | | 29.0 | Normalized 1650 F for 30 Min., A.C. |
| Average | 64.9 | 96.3 | .674 | 29.5 | |
| S3-380-9 | 62.6 | 97.8 | | 29.0 | Normalized 1750 F for 30 Min., A.C. |
| S3-380-10 | 62.2 | 97.5 | | 29.0 | Normalized 1750 F for 30 Min., A.C. |
| Average | 62.4 | 97.7 | .639 | 29.0 | |

TABLE III

MECHANICAL PROPERTIES OF WELDED AND NORMALIZED C—Mn STEEL (HEAT 4497226, 0.480-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| S6-480-11 | 63.0 | 84.1 | | 26.5 | As-Welded |
| S6-480-12 | 64.0 | 84.0 | | 26.5 | As-Welded |
| Average | 63.5 | 84.1 | .755 | 26.5 | |
| S6-480-1 | 50.3 | 87.3 | | 29.5 | Normalized 1350 F for 30 Min., A.C. |
| S6-480-2 | 49.8 | 86.3 | | 31.0 | Normalized 1350 F for 30 Min., A.C. |
| Average | 50.1 | 86.8 | .577 | 30.3 | |
| S6-480-3 | 53.1 | 87.5 | | 32.0 | Normalized 1450 F for 30 Min., A.C. |
| S6-480-4 | 53.1 | 86.9 | | 32.0 | Normalized 1450 F for 30 Min., A.C. |
| Average | 53.1 | 87.2 | .609 | 32.0 | |
| S6-480-5 | 61.4 | 89.4 | | 31.5 | Normalized 1550 F for 30 Min., A.C. |
| S6-480-6 | 62.2 | 90.0 | | 31.0 | Normalized 1550 F for 30 Min., A.C. |
| Average | 61.8 | 89.7 | .689 | 31.3 | |
| S6-480-7 | 62.5 | 89.5 | | 32.0 | Normalized 1650 F for 30 Min., A.C. |
| S6-480-8 | 61.1 | 89.2 | | 31.5 | Normalized 1650 F for 30 Min., A.C. |
| Average | 61.8 | 89.4 | .691 | 31.8 | |
| S6-480-9 | 62.5 | 90.5 | | 31.5 | Normalized 1750 F for 30 min., A.C. |
| S6-480-10 | 62.0 | 90.4 | | 31.5 | Normalized 1750 F for 30 Min., A.C. |
| Average | 62.3 | 90.5 | .688 | 31.5 | |

TABLE IV

MECHANICAL PROPERTIES OF WELDED AND NORMALIZED VANADIUM STEEL (HEAT 4423718, 0.380-INCH WALL THICKNESS)

| Sample No. | Yield Strength, ksi | Ultimate Tensile Strength, ksi | Y.S. / U.T.S. | Elongation, % in 2 in. | Heat Treatment |
|---|---|---|---|---|---|
| V5-380-11 | 68.2 | 92.0 | | 23.5 | As-Welded |
| V5-380-12 | 68.6 | 91.9 | | 25.0 | As-Welded |
| Average | 68.4 | 92.0 | .743 | 24.3 | |
| V5-380-1 | 52.8 | 93.1 | | 28.0 | Normalized 1350 F for 30 Min., A.C. |
| V5-380-2 | 51.5 | 92.2 | | 29.0 | Normalized 1350 F for 30 Min., A.C. |
| Average | 52.2 | 92.7 | .563 | 28.5 | |
| V5-380-3 | 56.5 | 92.7 | | 30.5 | Normalized 1450 F for 30 Min., A.C. |
| V5-380-4 | 56.6 | 93.0 | | 30.0 | Normalized 1450 F for 30 Min., A.C. |
| Average | 56.6 | 92.9 | .609 | 30.3 | |
| V5-380-5 | 65.1 | 96.2 | | 28.5 | Normalized 1550 F for 30 Min., A.C. |
| V5-380-6 | 63.0 | 94.3 | | 29.5 | Normalized 1550 F for 30 Min., A.C. |
| Average | 64.1 | 95.3 | .673 | 29.0 | |
| V5-380-7 | 65.6 | 97.7 | | 28.5 | Normalized 1650 F for 30 Min., A.C. |
| V5-380-8 | 65.6 | 98.0 | | 28.5 | Normalized 1650 F for 30 Min., A.C. |
| Average | 65.6 | 97.9 | .670 | 28.5 | |
| V5-380-9 | 73.8 | 110.3 | | 25.0 | Normalized 1750 F for 30 Min., A.C. |
| V5-380-10 | 73.2 | 109.9 | | 24.0 | Normalized 1750 F for 30 Min., A.C. |
| Average | 73.5 | 110.1 | .668 | 24.5 | |

TABLE V

MECHANICAL PROPERTIES OF WELDED AND NORMALIZED VANADIUM STEEL (HEAT 4423718, 0.480-INCH WALL THICKNESs)

| Sample No. | Yield Strength, ksi | Ultimate Tensile Strength, ksi | Y.S. / U.T.S. | Elongation, % in 2 in. | Heat Treatment |
|---|---|---|---|---|---|
| V4-480-11 | 68.6 | 89.7 | | 25.0 | As-Welded |
| V4-480-12 | 68.8 | 89.6 | | 25.0 | As-Welded |
| Average | 68.7 | 89.7 | .766 | 25.0 | |
| V4-480-1 | 55.1 | 89.7 | | 29.5 | Normalized 1350 F for 30 Min., A.C. |
| V4-480-2 | 54.0 | 88.8 | | 29.5 | Normalized 1350 F for 30 Min., A.C. |
| Average | 54.6 | 89.3 | .611 | 29.5 | |
| V4-480-3 | 58.9 | 91.1 | | 30.5 | Normalized 1450 F for 30 Min., A.C. |
| V4-480-4 | 58.5 | 91.2 | | 30.5 | Normalized 1450 F for 30 Min., A.C. |
| Average | 58.7 | 91.2 | .644 | 30.5 | |
| V4-480-5 | 64.4 | 92.3 | | 30.5 | Normalized 1550 F for 30 Min., A.C. |
| V4-480-6 | 64.3 | 92.4 | | 31.0 | Normalized 1550 F for 30 Min., A.C. |
| Average | 64.4 | 92.4 | .697 | 30.8 | |
| V4-480-7 | 66.7 | 94.0 | | 29.5 | Normalized 1650 F for 30 Min., A.C. |
| V4-480-8 | 68.9 | 95.9 | | 29.5 | Normalized 1650 F for 30 Min., A.C. |
| Average | 67.8 | 95.0 | .714 | 29.5 | |
| V4-480-9 | 75.2 | 104.2 | | 27.0 | Normalized 1750 F for 30 Min., A.C. |
| V4-480-10 | 75.0 | 105.4 | | 26.0 | Normalized 1750 F for 30 Min., A.C. |
| Average | 75.1 | 104.8 | .717 | 26.5 | |

TABLE VI

MECHANICAL PROPERTIES OF WELDED AND NORMALIZED CHROMIUM STEEL (HEAT 4423927, 0.380-INCH WALL THICKNESS)

| Sample No. | Yield Strength, ksi | Ultimate Tensile Strength, ksi | Y.S. / U.T.S. | Elongation, % in 2 in. | Heat Treatment |
|---|---|---|---|---|---|
| C5-380-11 | 65.0 | 90.0 | | 24.5 | As-Welded |
| C5-380-12 | 66.4 | 90.3 | | 23.5 | As-Welded |
| Average | 65.7 | 90.2 | .728 | 24.0 | |
| C5-380-1 | 46.6 | 89.5 | | 27.5 | Normalized 1350 F for 30 Min., A.C. |
| C5-380-2 | 46.6 | 87.6 | | 29.5 | Normalized 1350 F for 30 Min., A.C. |
| Average | 46.6 | 88.6 | .526 | 28.5 | |
| C5-380-3 | 53.9 | 96.6 | | 28.0 | Normalized 1450 F for 30 Min., A.C. |
| C5-380-4 | 51.2 | 93.9 | | 29.0 | Normalized 1450 F for 30 Min., A.C. |
| Average | 52.6 | 95.3 | .552 | 28.5 | |
| C5-380-5 | 61.7 | 97.5 | | 27.0 | Normalized 1550 F for 30 Min., A.C. |
| C5-380-6 | 59.1 | 198.6 | | 28.0 | Normalized 1550 F for 30 Min., A.C. |
| Average | 60.4 | 98.1 | .616 | 27.5 | |
| C5-380-7 | 61.1 | 102.0 | | 26.0 | Normalized 1650 F for 30 Min., A.C. |
| C5-380-8 | 58.8 | 100.2 | | 26.0 | Normalized 1650 F for 30 Min., A.C. |
| Average | 60.0 | 101.1 | .593 | 26.0 | |
| C5-380-9 | 72.6 | 114.6 | | 21.0 | Normalized 1750 F for 30 Min., A.C. |
| C5-380-10 | 74.4 | 115.7 | | 19.5 | Normalized 1750 F for 30 Min., A.C. |

TABLE VI-continued

MECHANICAL PROPERTIES OF WELDED AND NORMALIZED CHROMIUM STEEL (HEAT 4423927, 0.380-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| Average | 73.5 | 115.2 | .638 | 20.3 | |

TABLE VII

MECHANICAL PROPERTIES OF WELDED AND NORMALIZED CHROMIUM STEEL HEAT 4423927, 0.480-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| C4-480-11 | 67.7 | 89.5 | | 23.0 | As-Welded |
| C4-480-12 | 69.0 | 90.4 | | 22.0 | As-Welded |
| Average | 68.4 | 90.0 | .760 | 22.5 | |
| C4-480-1 | 48.7 | 91.2 | | 28.0 | Normalized 1350 F for 30 Min., A.C. |
| C4-480-2 | 47.8 | 90.4 | | 27.5 | Normalized 1350 F for 30 Min., A.C. |
| Average | 48.3 | 90.8 | .532 | 27.8 | |
| C4-480-3 | 56.0 | 95.5 | | 28.5 | Normalized 1450 F for 30 Min., A.C. |
| C4-480-4 | 55.6 | 95.3 | | 28.5 | Normalized 1450 F for 30 Min., A.C. |
| Average | 55.8 | 95.4 | .585 | 28.5 | |
| C4-480-5 | 62.5 | 98.7 | | 28.0 | Normalized 1550 F for 30 Min., A.C. |
| C4-480-6 | 63.2 | 99.9 | | 27.0 | Normalized 1550 F for 30 Min., A.C. |
| Average | 62.9 | 99.3 | .633 | 27.5 | |
| C4-480-7 | 62.6 | 103.9 | | 24.5 | Normalized 1650 F for 30 Min., A.C. |
| C4-480-8 | 61.4 | 101.4 | | 26.0 | Normalized 1650 F for 30 Min., A.C. |
| Average | 62.0 | 102.2 | .607 | 25.3 | |
| C4-480-9 | 73.3 | 116.8 | | 20.0 | Normalized 1750 F for 30 Min., A.C. |
| C4-480-10 | 72.4 | 116.9 | | 20.0 | Normalized 1750 F for 30 Min., A.C. |
| Average | 72.9 | 116.9 | .624 | 20.0 | |

As shown in Table II and FIG. 1, the minimum ultimate tensile strength requirement of 95 ksi can only be achieved in the basic carbon-manganese steel casing processed in a wall section of 0.380 inches when normalized at temperatures above 1550° F. When the same steel was processed in a 0.480 inch wall section (Table III and FIG. 2), the minimum 95 ksi strength level was not achieved at any normalizing temperature. It will also be seen that the yield strength at the 0.480 inch wall section was below the desired 55 ksi minimum when normalized at the temperatures of 1350° F. and 1450° F.

Microstructural changes were observed in the carbon-manganese steel with increasing normalizing temperatures. At the lowest temperature (1350° F.), the microstructure consisted of degenerate pearlite with considerable banding. At a higher normalizing temperature (1550° F.), the microstructure appeared to be less banded and consisted of degenerate and very fine pearlite. At the highest normalizing temperature studied (1750° F.), the microstructure consisted of large patches of fine pearlite with the amount of banding being drastically reduced.

Figure 6:
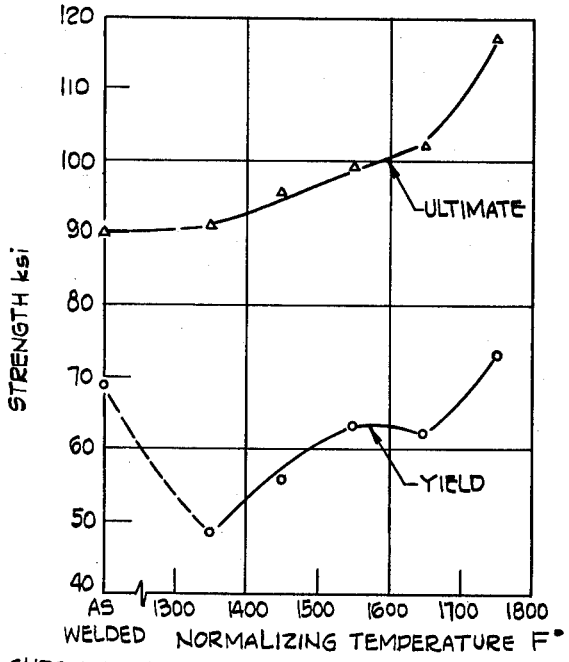

The test results of the vanadium-containing steel casing of both wall thicknesses are represented in Table IV and V and by FIGS. 6 and 7. The data shows that it was necessary to normalize the 0.380 inch wall section at or greater than 1550° F. in order consistently to meet the minimum strength requirements, and that it was necessary to normalize the 0.480 inch wall section at or above 1650° F.

The microstructural changes observed in the vanadium steel at different normalizing temperatures was similar to the changes observed in the carbon-manganese steel with the exception of slightly less banding.

Figure 5:
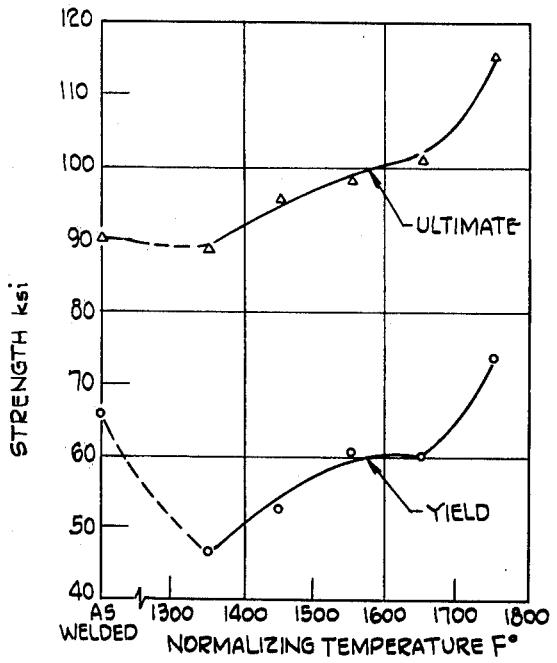
FIGS. 5 and 6 are graphs showing the yield and ultimate tensile strengths of a chromium alloyed steel casing according to the present invention of two different wall sections normalized at varying temperatures.

The test results obtained from the chromium steel casing of both wall thicknesses are presented in Tables VI and VII and FIGS. 5 and 6. These results show that at a normalizing temperature as low as 1450° F., the ultimate tensile strength exceeded the minimum level of 95 ksi in both wall sections. The yield strength to ultimate tensile strength ratio was less than both the carbon-manganese steel and the vanadium alloyed steel, however, the desired 55 ksi minimum yield strength can be obtained by normalizing as low as 1550° and 1450° F. in the case of the 0.380 and 0.480 inch wall section pipe, respectively.

Another significant feature indicated by the foregoing results is that the chromium steel casing of the invention was the most consistent in meeting and surpassing the ultimate tensile strength requirement of 95 ksi. With the carbon-manganese and vanadium alloyed steel casings, the minimum strength level was barely achieved by normalizing at high temperatures. With the chromium alloyed steel of the invention, a high normalizing temperature of 1750° F. could be used to produce an ultimate tensile strength far in excess of the minimum 95 ksi level. This advantage provides a safety margin with respect to mechanical properties and affords greater leeway in normalizing temperature variations.

Microstructural studies on the chromium steel revealed differences in the microstructure produced by normalizing as compared to the carbon-manganese and vandadium steels. Whereas the latter two steels were associated with ferrite-pearlite microstructures, the chromium steel contained quantities of acicular structure believed to be bainite. This structure is believed to be responsible for the substantial and unexpected increases in tensile strength properties for the steel of the invention.

Table VIII sets out the compositions of six steels which were evaluated to determine the effect of carbon on mechanical properties. The carbon content ranged from about 0.24 to about 0.30%. Specimens of all six steels were rolled to ½ inch thickness and normalized at temperatures ranging from 1350° F. to 1750° F. The test results indicating the effect of carbon in the ½ inch thick specimens are presented in Tables IX to XIV.

TABLE VIII

| | CHEMICAL COMPOSITIONS | | | | | | | |
|---|---|---|---|---|---|---|---|---|
| Heat | C | Mn | Si | P | S | Cr | Ni | Al |
| E83 | 0.24 | 1.39 | 0.23 | 0.016 | 0.022 | 0.27 | 0.07 | 0.022 |
| E84 | 0.26 | 1.40 | 0.23 | 0.016 | 0.016 | 0.50 | 0.07 | 0.031 |
| E85 | 0.26 | 1.38 | 0.21 | 0.016 | 0.017 | 0.75 | 0.07 | 0.043 |
| E87 | 0.30 | 1.39 | 0.22 | 0.016 | 0.022 | 0.26 | 0.07 | 0.029 |
| E88 | 0.30 | 1.42 | 0.21 | 0.016 | 0.021 | 0.49 | 0.07 | 0.029 |
| E89 | 0.30 | 1.42 | 0.22 | 0.017 | 0.022 | 0.74 | 0.07 | 0.026 |

TABLE IX

MECHANICAL PROPERTIES OF HEAT E83 (0.24 C, 1.39 Mn, 0.27 Cr)

| Specimen No. | Yield Strength, (ksi) | Ultimate Tensile Strength, (ksi) | Elongation, (% in 2 in) | Heat Treatment |
|---|---|---|---|---|
| E83-1 | 51.2 | 80.8 | 33.0 | Normalized 1350F for 30 min., A.C. |
| E83-2 | 51.9 | 81.5 | 32.0 | Normalized 1350F for 30 min., A.C. |
| Average | 51.6 | 81.2 | 32.5 | |
| E83-3 | 53.7 | 81.0 | 33.0 | Normalized 1450F for 30 min., A.C. |
| E83-4 | 53.4 | 81.8 | 32.5 | Normalized 1450F for 30 min., A.C. |
| Average | 53.6 | 81.4 | 32.8 | |
| E83-5 | 62.5 | 88.0 | 32.5 | Normalized 1550F for 30 min., A.C. |
| E83-6 | 61.1 | 88.2 | 33.0 | Normalized 1550F for 30 min., A.C. |
| Average | 61.8 | 88.1 | 32.8 | |
| E83-7 | 62.2 | 88.1 | 32.5 | Normalized 1650F for 30 min., A.C. |
| E83-8 | 62.0 | 87.9 | 32.5 | Normalized 1650F for 30 min., A.C. |
| Average | 62.1 | 88.0 | 32.5 | |
| E83-9 | 62.2 | 87.7 | 32.5 | Normalized 1750F for 30 min., A.C. |
| E83-10 | 62.9 | 88.4 | 32.5 | Normalized 1750F for 30 min., A.C. |
| Average | 62.6 | 88.1 | 32.5 | |
| E83-11 | 54.6 | 84.7 | 31.5 | As rolled |
| E83-12 | 55.2 | 85.4 | 31.5 | As rolled |
| Average | 54.9 | 85.1 | 31.5 | |

TABLE X

MECHANICAL PROPERTIES OF HEAT E87 (0.30 C, 1.42 Mn, 0.26 Cr)

| Specimen No. | Yield Strength, (ksi) | Ultimate Tensile Strength, (ksi) | Elongation, (% in 2 in) | Heat Transfer |
|---|---|---|---|---|
| E87-1 | 49.9 | 84.2 | 31.0 | Normalized 1350F for 30 min., A.C. |
| E87-2 | 50.9 | 85.1 | 32.0 | Normalized 1350F for 30 min., A.C. |
| Average | 50.4 | 84.7 | 31.5 | |
| E87-3 | 52.9 | 86.3 | 32.0 | Normalized 1450F for 30 min., A.C. |
| E87-4 | 53.3 | 90.0 | 30.5 | Normalized 1450F for 30 min., A.C. |
| Average | 53.1 | 88.2 | 31.3 | |
| E87-5 | 65.4 | 94.8 | 31.5 | Normalized 1550F for 30 min., A.C. |
| E87-6 | 64.4 | 94.3 | 30.5 | Normalized 1550F for 30 min., A.C. |
| Average | 64.9 | 94.6 | 31.0 | |
| E87-7 | 67.3 | 95.4 | 30.0 | Normalized 1650F for 30 min., A.C. |
| E87-8 | 65.9 | 94.5 | 30.5 | Normalized 1650F for 30 min., A.C. |
| Average | 66.6 | 95.0 | 30.3 | |
| E87-9 | 66.8 | 95.7 | 30.5 | Normalized 1750F for 30 min., A.C. |
| E87-10 | 66.0 | 95.1 | 31.0 | Normalized 1750F for 30 min., A.C. |
| Average | 66.4 | 95.4 | 30.8 | |
| E87-11 | 55.1 | 91.1 | 29.0 | As Rolled |
| E87-12 | 54.9 | 91.2 | 29.0 | As Rolled |
| Average | 55.0 | 91.2 | 29.0 | |

TABLE XI

MECHANICAL PROPERTIES OF HEAT E84 (0.26 C, 1.40 Mn, 0.05Cr)

| Specimen No. | Yield Strength, (ksi) | Ultimate Tensile Strength, (ksi) | Elongation, (% in 2 in) | Heat Transfer |
|---|---|---|---|---|
| E84-1 | 49.0 | 82.3 | 32.5 | Normalized 1350F for 30 min., A.C. |
| E84-2 | 51.0 | 83.2 | 32.5 | Normalized 1350F for 30 min., A.C. |
| Average | 50.0 | 82.8 | 32.5 | |
| E84-3 | 53.1 | 87.3 | 31.0 | Normalized 1450F for 30 min., A.C. |
| E84-4 | 54.1 | 87.3 | 30.5 | Normalized 1450F for 30 min., A.C. |

TABLE XI-continued

MECHANICAL PROPERTIES OF HEAT E84
(0.26 C, 1.40 Mn, 0.05Cr)

| Specimen No. | Yield Strength, (ksi) | Ultimate Tensile Strength, (ksi) | Elongation, (% in 2 in) | Heat Transfer |
|---|---|---|---|---|
| Average | 53.6 | 87.3 | 30.8 | |
| E84-5 | 63.6 | 92.8 | 31.0 | Normalized 1550F for 30 min., A.C. |
| E84-6 | 63.5 | 92.8 | 31.0 | Normalized 1550F for 30 min., A.C. |
| Average | 63.6 | 92.8 | 31.0 | |
| E84-7 | 66.0 | 94.1 | 31.5 | Normalized 1650F for 30 min., A.C. |
| E84-8 | 66.2 | 94.0 | 30.5 | Normalized 1650F for 30 min., A.C. |
| Average | 66.1 | 94.1 | 31.0 | |
| E84-9 | 62.5 | 92.7 | 31.5 | Normalized 1750F for 30 min., A.C. |
| E84-10 | 64.5 | 93.6 | 31.5 | Normalized 1750F for 30 min., A.C. |
| Average | 63.5 | 93.2 | 31.5 | |
| E84-11 | 54.6 | 89.6 | 29.5 | As Rolled |
| E84-12 | 54.4 | 90.1 | 29.5 | As Rolled |
| Average | 54.5 | 89.9 | 29.5 | |

TABLE XII

MECHANICAL PROPERTIES OF HEAT E88
(0.30 C, 1.42 Mn, 0.49 Cr)

| Specimen No. | Yield Strength, (ksi) | Ultimate Tensile Strength, (ksi) | Elongation, (% in 2 in.) | Heat Treatment |
|---|---|---|---|---|
| E88-1 | 51.8 | 87.2 | 31.5 | Normalized 1350F for 30 min., A.C. |
| E88-2 | 51.4 | 86.9 | 31.5 | |
| Average | 51.6 | 87.1 | 31.5 | |
| E88-3 | 55.2 | 91.5 | 31.0 | Normalized 1450F for 30 min., A.C. |
| E88-4 | 53.5 | 90.3 | 30.0 | Normalized 1450F for 30 min., A.C. |
| Average | 54.4 | 90.0 | 30.5 | |
| E88-5 | 64.9 | 96.8 | 30.0 | Normalized 1550F for 30 min., A.C. |
| E88-6 | 64.0 | 96.7 | 30.0 | Normalized 1550F for 30 min., A.C. |
| Average | 64.5 | 96.8 | 30.0 | |
| E88-7 | 67.7 | 98.9 | 30.5 | Normalized 1650F for 30 min., A.C. |
| E88-8 | 65.9 | 97.8 | 29.0 | Normalized 1650F for 30 min., A.C. |
| Average | 66.8 | 98.4 | 29.8 | |
| E88-9 | 65.7 | 98.1 | 29.5 | Normalized 1750F for 30 min., A.C. |
| E88-10 | 66.9 | 98.7 | 20.0 | Normalized 1750F for 30 min., A.C. |
| Average | 66.3 | 98.4 | 29.8 | |
| E88-11 | 55.6 | 93.9 | 29.0 | As Rolled |
| E88-12 | 55.3 | 93.7 | 29.0 | As Rolled |
| Average | 55.5 | 93.8 | 29.0 | |

TABLE XIII

MECHANICAL PROPERTIES OF HEAT E85
(0.26 C, 1.38 Mn, 0.75 Cr)

| Specimen No. | Yield Strength, (ksi) | Ultimate Tensile Strength, (ksi) | Elongation, (% in 2 in.) | Heat Treatment |
|---|---|---|---|---|
| E85-1 | 47.9 | 83.8 | 32.0 | Normalized 1350F for 30 min., A.C. |
| E85-2 | 47.8 | 83.8 | 32.5 | Normalized 1350F for 30 min., A.C. |
| Average | 47.9 | 83.8 | 32.5 | |
| E85-3 | 53.9 | 88.3 | 29,5 | Normalized 1450F for 30 min., A.C. |
| E85-4 | 54.1 | 89.0 | 30.5 | Normalized 1450F for 30 min., A.C. |
| Average | 54.0 | 88.7 | 30.0 | |
| E85-5 | 64.6 | 94.3 | 31.5 | Normalized 1550F for 30 min., A.C. |
| E85-6 | 64.4 | 94.1 | 31.0 | Normalized 1550F for 30 min., A.C. |
| Average | 64.5 | 94.2 | 31.3 | |
| E85-7 | 64.8 | 93.2 | 29.0 | Normalized 1650F for 30 min., A.C. |
| E85-8 | 66.2 | 94.9 | 31.0 | Normalized 1650F for 30 min., A.C. |
| Average | 65.6 | 94.1 | 30.0 | |
| E85-9 | 65.2 | 94.3 | 31.0 | Normalized 1750F for 30 min., A.C. |
| E85-10 | 65.6 | 94.4 | 31.0 | Normalized 1750F for 30 min., A.C. |
| Average | 65.4 | 94.4 | 31.0 | |
| E85-11 | 54.6 | 89.6 | 29.5 | As Rolled |
| E85-12 | 54.4 | 90.1 | 29.5 | As Rolled |
| Average | 54.5 | 89.9 | 29.5 | |

TABLE XIV

MECHANICAL PROPERTIES OF HEAT E89 (0.30 C, 1.39 Mn, 0.74 Cr)

| Specimen No. | Yield Strength, (ksi) | Ultimate Tensile Strength, (ksi) | Elongation, (% in 2 in.) | Heat Treatment |
|---|---|---|---|---|
| E89-1 | 47.3 | 87.3 | 29.5 | Normalized 1350F for 30 min., A.C. |
| E89-2 | 49.9 | 87.8 | 30.0 | Normalized 1350F for 30 min., A.C. |
| Average | 48.6 | 87.6 | 29.8 | |
| E89-3 | 54.4 | 94.2 | 29.0 | Normalized 1450F for 30 min., A.C. |
| E89-4 | 57.1 | 94.6 | 30.0 | Normalized 1450F for 30 min., A.C. |
| Average | 55.8 | 94.4 | 29.5 | |
| E89-5 | 67.8 | 99.3 | 29.5 | Normalized 1550F for 30 min., A.C. |
| E89-6 | 68.7 | 99.8 | 29.5 | Normalized 1550F for 30 min., A.C. |
| Average | 68.3 | 99.6 | 29.5 | |
| E89-7 | 70.3 | 100.8 | 29.0 | Normalized 1650F for 30 min., A.C. |
| E89-8 | 66.8 | 99.1 | 28.0 | Normalized 1650F for 30 min., A.C. |
| Average | 68.6 | 100.0 | 28.5 | |
| E89-9 | 68.9 | 100.0 | 29.0 | Normalized 1750F for 30 min., A.C. |
| E89-10 | 71.3 | 101.1 | 29.0 | Normalized 1750F for 30 min., A.C. |
| Average | 70.1 | 100.6 | 29.0 | |
| E89-11 | 54.8 | 93.8 | 27.0 | As Rolled |
| E89-12 | 54.9 | 94.2 | 28.0 | As Rolled |
| Average | 54.9 | 94.0 | 27.5 | |

It will be seen from Table IX that the desired minimum tensile strength of 95 ksi was not achieved in the ½ inch thick specimens at any normalizing temperature in the case of steel E83 which had a carbon level of 0.24% and a chromium content of 0.27%. Steel E87 which had essentially the same composition except for a higher carbon content of 0.30% provided a 95 ksi tensile strength when normalized at 1650° F.

The desired minimum tensile strength was not achieved at any normalizing temperature in the case of steel E84 which had a carbon content of 0.26% and a chromium content of 0.50%. When the carbon content was increased to 0.30% (steel E88), the tensile properties were met by normalizing at 1550° F. (Table XII). Steel 4423927 (Table I) also had a composition similar to steel E84 ecept for a carbon content of 0.28%. When that steel was processed in a wall section of 0.480 inches, an average tensile strength of 95.4 ksi was achieved by normalizing at 1450° F.

Steel E85 had a carbon content of 0.26% and a chromium content of 0.75%. As shown in Table XIII, a tensile strength of 95 ksi was not reached at any normalizing temperature. By way of comparison, when steel E89 having essentially the same chromium level and a carbon content of 0.30% was normalized at 1550° F., the average tensile strength was 99.6 (Table XIV).

Based on the data reported in Tables VI, VII and IX to XIV, the preferred minimum carbon content of casing having a wall thickness of ⅜ inch or more is 0.28%. When casing having a thickness of ⅜ inch or more is made from an aluminum killed steel having the preferred composition consisting of 0.28 to 0.40% carbon, 1.00 to 1.75% manganese, 0.15 to 0.50% silicon, and 0.20 to 1.00% chromium, it is possible to achieve a high tensile strength of 95 ksi minimum and relatively low yield strengths of from 55 to 80 ksi by subjecting the casing to a normalizing heat treatment. It will be understood that in thinner wall casing, e.g. from about ¼ to ⅜ inch thickness, the carbon content may range to a minimum of 0.20%.

Many modifications and variations of the invention will be apparent to those skilled in the art in light of the foregoing disclosure. Therefore, it is to be understood that, within the scope of the appended claims, the invention can be practiced otherwise than as specifically shown and described.

What is claimed is:

1. A normalized, rolled and welded tubular product having a wall thickness of about ⅜ inch or more formed of an aluminum-killed steel consisting essentially of from 0.28 to 0.40% carbon, from 1.00 to 1.75% manganese, from 0.15 to 0.50% silicon, from 0.20 to 1.00% chromium, and the balance iron, said steel being further characterized by a yield strength of about 55 to 80 ksi and a minimum ultimate tensile strength of about 95 ksi.

2. A normalized, rolled and welded tubular product having a maximum wall thickness of about ⅜ inch formed of an aluminum-killed steel consisting essentially of from 0.20 to 0.40% carbon, from 1.00 to 1.75% manganese, from 0.15 to 0.50% silicon, from 0.20 to 1.00% chromium, and the balance iron, said steel being further characterized by a minimum ultimate tensile strength of about 95 ksi and a yield strength of from about 55 to 80 ksi.

* * * * *

UNITED STATES PATENT AND TRADEMARK OFFICE

CERTIFICATE OF CORRECTION

PATENT NO. : 4,256,517

DATED : March 17, 1981

INVENTOR(S) : George M. Waid and Anthony T. Davenport

It is certified that error appears in the above—identified patent and that said Letters Patent is hereby corrected as shown below:

In Columns 5 and 6, TABLE VI, the Ultimate Tensile Strength for Sample No. C5-380-6 should read --98.6-- and not "198.6".

Figure 3:
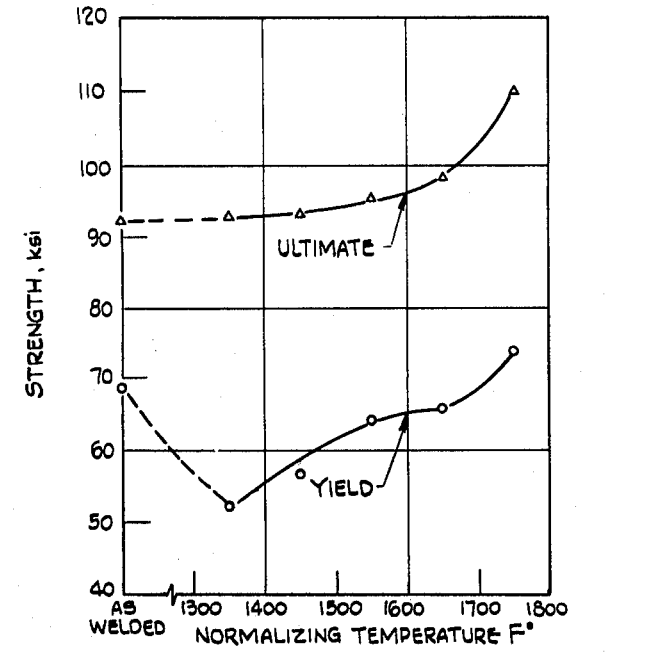
FIGS. 3 and 4 are graphs showing the yield and ultimate tensile strengths of a vanadium alloyed steel casing of two different wall sections normalized at varying temperatures.
Figure 4:
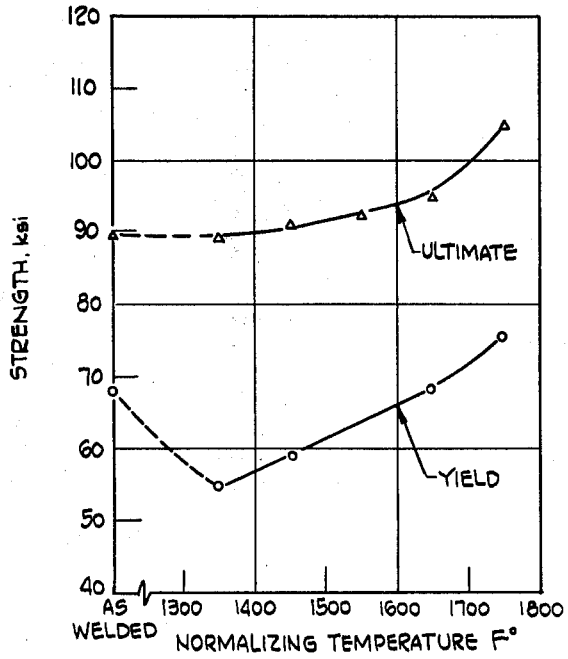

In Column 7, line 57, "FIGS. 6 and 7" should read --FIGS. 3 and 4--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*